United States Patent [19]

King et al.

[11] 4,153,088

[45] May 8, 1979

[54] HYDRAULIC LOG SPLITTER ATTACHMENT FOR FARM TRACTORS AND INDUSTRIAL TRACTORS

[76] Inventors: William L. King; William U. King, both c/o George Spector, 3615 Woolworth Bldg., 233 Broadway; George Spector, 3615 Woolworth Bldg., 233 Broadway, all of, New York, N.Y. 10007

[21] Appl. No.: 811,696

[22] Filed: Jun. 30, 1977

[51] Int. Cl.[2] ..... B27L 7/00

[52] U.S. Cl. ..... 144/193 A; 144/193 R; 144/193 K

[58] Field of Search ..... 144/193 A, 193 R, 307, 144/193 K

[56] References Cited

U.S. PATENT DOCUMENTS

| | | | |
|---|---|---|---|
| 298,560 | 5/1884 | Doty | 144/307 |
| 3,319,675 | 5/1967 | Bles | 144/193 A |
| 3,862,651 | 1/1975 | Heikkinen | 144/193 A X |
| 4,066,110 | 1/1978 | Sarno | 144/193 A |

*Primary Examiner*—Donald R. Schran

[57] ABSTRACT

An accessory for attachment to a tractor and in which is used to split logs effortlessly and quickly; the accessory including a hydraulically operated ram that pushes a log against a stationary wedge that splits the log, and the accessory being mounted on a frame movable upon wheels.

2 Claims, 5 Drawing Figures

HYDRAULIC LOG SPLITTER ATTACHMENT FOR FARM TRACTORS AND INDUSTRIAL TRACTORS

This invention relates generally to tractor attachments. More specifically it relates to machinery for making firewood.

A principal object of the present invention is to provide an accessory powered from a tractor to split logs in a quick and effortless manner.

Another object is to provide a log splitter attachment which requires no need for modification, disconnection of hydraulic lines or special tools for hook up to any farm or industrial tractor that is equipped with a hydraulic top link.

Another object is to provide a log splitter attachment which can be used from any tractor or truck having a hydraulic potential of 2000 PSI as long as a hydraulic cylinder is attached to the splitter.

Other objects are to provide a hydraulic log splitter attachment for farm tractors and industrial tractors which is simple in design, inexpensive to manufacture, rugged in construction, easy to use and efficient in operation.

These and other objects will be readily evident upon a study of the following specification and the accompanying drawing herein.

Figure 1:
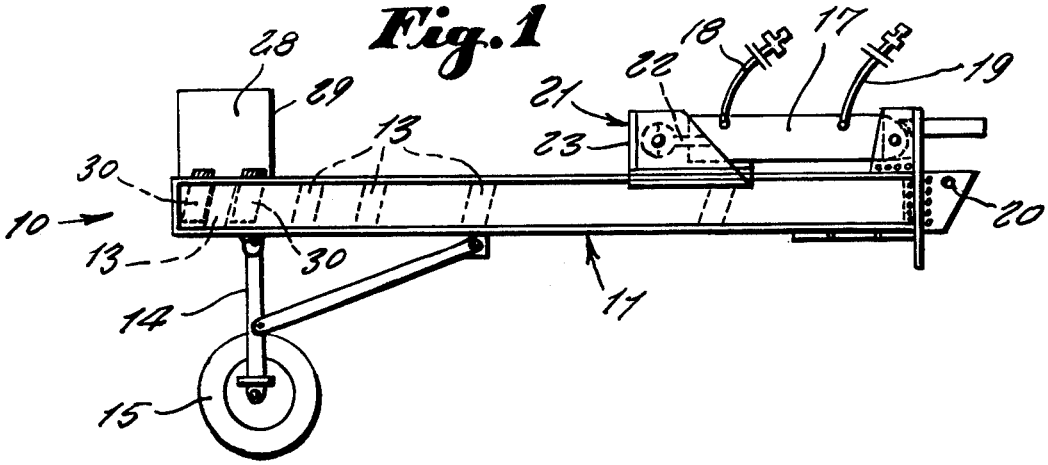
FIG. 1 is a side view of the invention.
Figure 2:
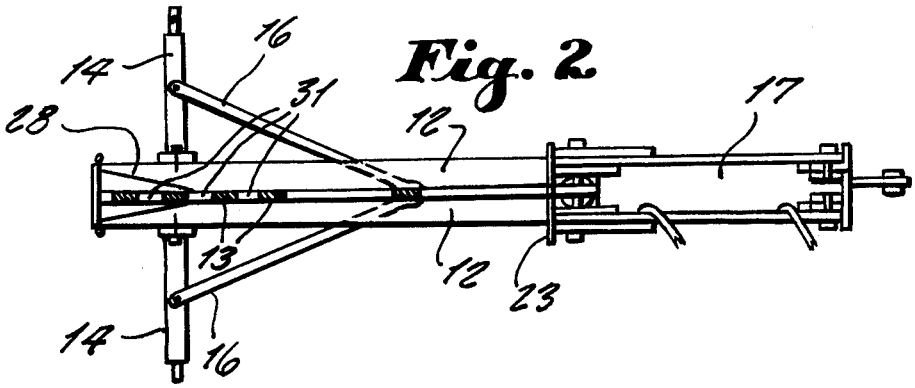
FIG. 2 is a top view thereof.
Figure 3:
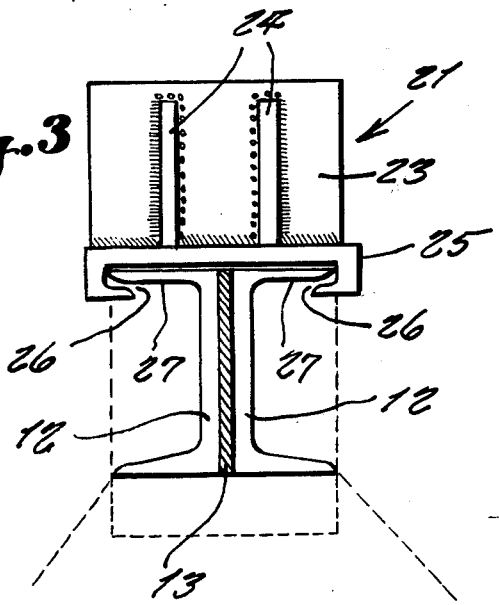
FIG. 3 is an enlarged rear view of the ram pressure plate.
Figure 4:
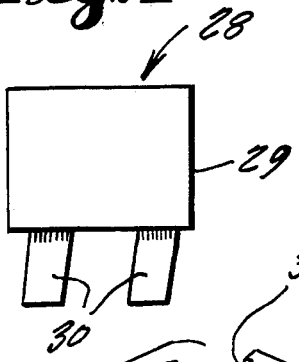
FIG. 4 is a side view of the splitting wedge as a standard unit.

Refering now to the drawing in detail, and more particularly to FIGS. 1 to 4 thereof at this time, the reference numeral 10 represents a log splitter attachment according to the present invention wherein the same includes a frame 11 made of a pair of parallel, spaced apart, steel channels 12 fitted with spacers 13 therebetween.

A pair of downwardly diverging legs 14, secured under one end of the channels, are each mounted on a removable wheel 15 for travel on a surface when moving the device from place to place. Braces 16 steady the legs to the channels.

Upon an opposite end of the channels there is mounted a hydraulic cylinder 17 having hydraulic lines 18 and 19 extending therefrom for connection to a hydraulic system of a tractor, truck or the like. A hole 20 on the end of the frame 11 serves to receive a mounting bolt for securely connecting the log splitter attachment mechanically to the tractor ot the like during the operation thereof.

A ram upon the outer end of a piston rod 22 of the cylinder comprises a transverse extending heavy steel plate 23 welded with braces 24 on a rear side thereof to a base plate 25 which upon its underside has grooves 26 along opposite side edges so to slidably receive the side edges of the channel flanges 27 therebetween in order that the ram can slide along the frame.

At the opposite end of a frame there is adjustably mounted a steel splitter block 28 which is wedge-shaped and having its thin blade edge 29 pointed in a direction toward the sliding ram. A pair of angularly downwardly extending feet 30 are welded to an underside of the splitter block so to be selectively receivable in shots 31 that are formed between the frame channels and between the spacers 13; it being noted in FIG. 1, that the frame spacers are correspondingly at a same downwardly inclined angle as the bars 30. Thus the feet 30 can be braced against any of the spacers as selected, so to firmly hold the splitter block at any selected distance away from the ram.

Thus, is operative use, any length of sawed off cord wood log can be placed upon the frame between the splitter block and ram, after which the hydraulic system to the hydraulic cylinder is turned on and causes the ram to be pushed against the end 32 of the cord wood log so that the opposite end 33 thereof is forced against the splitter block which thus splits the cord wood into two pieces.

Figure 5:
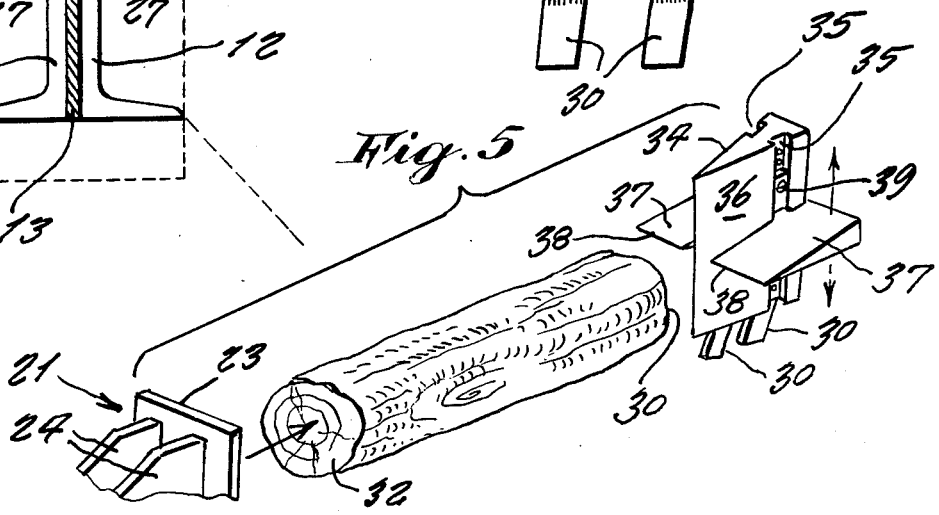
FIG. 5 is a view of a modified design (used as an accessory) of the invention wherein the wedge supports a horizontal cross wedge on each side so a log can be split in four sections at the same time; the cross wedges each being individually vertically adjustable so to suit different diameters of logs, when splitting a large number thereof.

In FIG. 5, a modified design of splitter block 34 includes grooves 35 on opposite side faces 36 thereof in each of which a transverse extending wedge 37 is slidably carried so to have a blade edge 38 at horizontal right angle to the perpendicular blade edge 29, so that an operative use a cord wood is thus split into four pieces instead. The wedge 37 is adjustably secured to the splitter block at any desired position by a set 39, so to raise or lower the wedge and accordingly accomodate any thinkness of cord wood and split it along its center. Wedges 37 can be of course, dis-aligned with each other independently as wished to vary splits.

Thus different designs of the invention are presented.

While various changes may be made in the detail construction, it is understood that such changes will be within the spirit and scope of the present invention, as is defined by the appended claims.

What is claimed is:

1. In a hydraulic log splitter attachment, the combination of a frame with an upper surface comprised of a pair of opposing parallel, spaced apart metal channels with web members separated by a row of inclined spaced apart spacers welded to said web members, one end of said frame supported upon legs having wheels, and opposite end of said frame having a bolt mounting opening therethrough for attachment to a tractor or other hydraulic power source, a hydraulic cylinder mounted axially upon said opposite end of said frame, a ram and a piston rod connected to said hydraulic cylinder, said cylinder having hydraulic lines extending therefrom for connection to said power source, the first said end of said frame adjustably supporting a splitter block having downward inclined feet for placement selectively between said spacers, and said splitter block being wedge-shaped with a blade edge thereof facing toward said ram, said ram slidably engaging said frame, so to force a cord wood log placed between said ram and said splitter block against said splitter block blade edge so to split said log, said block having a lower surface engaging said upper surface for support, including means on said block to cut the log at right angles to said blade edge.

2. The combination as set fourth in claim 1, wherein said means are a pair of similar wedges having auxillary blades at right angle to said splitter block blade edge are mounted on opposite sides of said block, including coacting means on said similar wedges and block for setting said auxilliary blades at selected positions above said lower surface of said block.

* * * * *